US006428108B1

(12) United States Patent
Chase

(10) Patent No.: US 6,428,108 B1
(45) Date of Patent: Aug. 6, 2002

(54) TILE AND CARPET REMOVAL APPARATUS

(76) Inventor: Rex Henry Chase, 2228 Bedal La., Everett, WA (US) 98208

( * ) Notice: Subject to any disclaimer, the term of this patent is extended or adjusted under 35 U.S.C. 154(b) by 0 days.

(21) Appl. No.: 09/630,158

(22) Filed: Jul. 31, 2000

Related U.S. Application Data

(60) Provisional application No. 60/147,183, filed on Aug. 5, 1999.

(51) Int. Cl.[7] ..... E21C 47/00; B32B 31/18

(52) U.S. Cl. ..... 299/36.1; 30/169; 15/93.1

(58) Field of Search ..... 299/36.1, 37.1; 30/169, 170; 15/93.1; 29/81.16; 81/45; 172/252, 253, 817, 810; 37/274

(56) References Cited

U.S. PATENT DOCUMENTS

| | | | | | |
|---|---|---|---|---|---|
| 729,265 | A | * | 5/1903 | Brazel | 37/274 X |
| 839,994 | A | * | 1/1907 | Hase | 30/170 |
| 889,496 | A | * | 6/1908 | Ackermann | 30/170 |
| 2,262,415 | A | * | 11/1941 | Williams et al. | 299/36.1 X |
| 2,840,932 | A | * | 7/1958 | Breyer | 172/252 X |
| 3,074,090 | A | | 1/1963 | Thompson | |
| 3,376,071 | A | | 4/1968 | Stein | |
| 3,475,056 | A | * | 10/1969 | Jones | 299/24 |
| 3,563,608 | A | | 2/1971 | Crispino | |
| 3,726,565 | A | * | 4/1973 | Oliverius | 299/37.1 |
| 3,851,921 | A | * | 12/1974 | Makishima | 299/37.1 |
| 4,407,035 | A | | 10/1983 | Lindqvist | |
| 4,981,548 | A | * | 1/1991 | Poll | 156/584 |
| 5,002,629 | A | | 3/1991 | Nakamura | |
| 5,037,160 | A | | 8/1991 | Ukai | |
| 5,075,985 | A | * | 12/1991 | Mensch | 37/407 |
| 5,098,506 | A | | 3/1992 | Brown et al. | |
| 5,197,784 | A | | 3/1993 | Holder | |
| 5,525,182 | A | | 6/1996 | Miller | |
| 5,641,206 | A | * | 6/1997 | Craft | 299/37.1 |
| 5,702,161 | A | | 12/1997 | Finney et al. | |
| 5,713,637 | A | | 2/1998 | Worden et al. | |
| 5,741,047 | A | * | 4/1998 | Ordonez | 299/37.1 |
| 5,772,284 | A | | 6/1998 | Lindsey et al. | |
| 5,829,534 | A | | 11/1998 | Easton et al. | |
| 5,830,313 | A | | 11/1998 | Smith | |
| 6,092,876 | A | * | 7/2000 | Arbucci | 299/37.1 |

* cited by examiner

*Primary Examiner*—David Bagnell
*Assistant Examiner*—Sunil Singh

(57) ABSTRACT

An apparatus and method for removing floor covering. The apparatus includes a frame that attaches to the front end of a loader type vehicle. An arm connects to and extends forward from the frame, and has a tapered end portion with a terminal end to which a sharp blade attaches and extends forward for separating floor covering from a floor as the vehicle is driven forward pressing the blade against the floor. A deflector extends upward from on top of the tapered portion to deflect removed materials off of the top of the tapered portion. At least one resilient sweep extends downward from the frame to the floor and is vertically slidable relative to the frame to accommodate variations in the floor and vertical motion of the apparatus while maintaining contact with the floor to collect removed floor covering material ahead of the loader as floor covering is removed so that removed floor covering is not run over by the loader. A reservoir may optionally be supported by the arm for spraying water on the floor covering as it is removed to abate dust, which may contain hazardous material such as asbestos.

21 Claims, 4 Drawing Sheets

FIG. 4
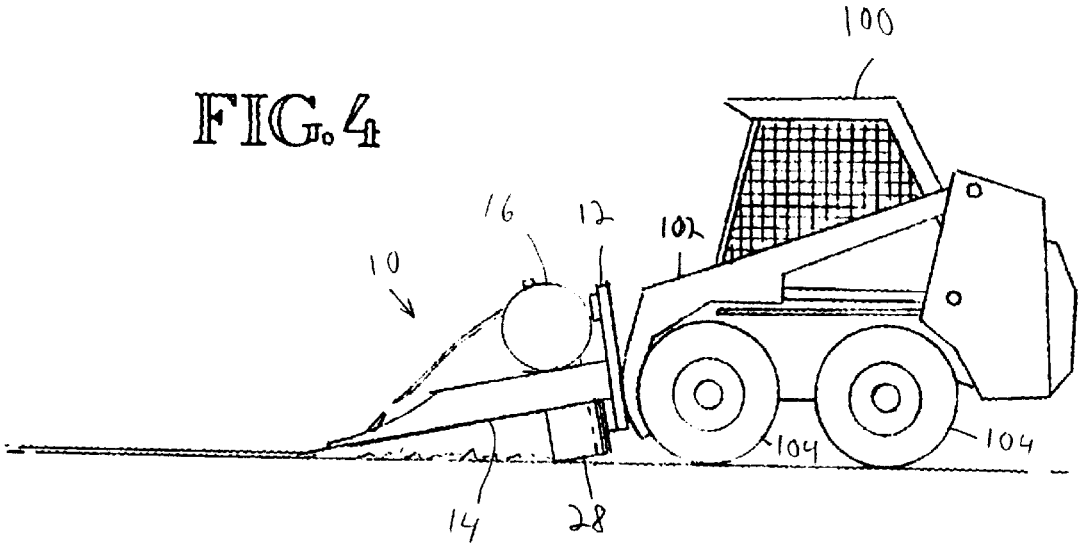
FIG. 5
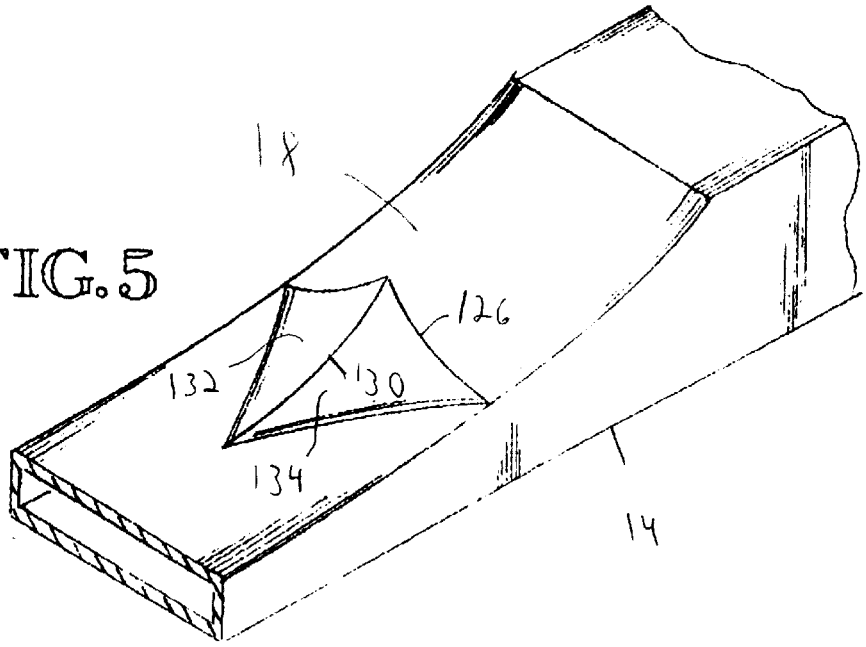
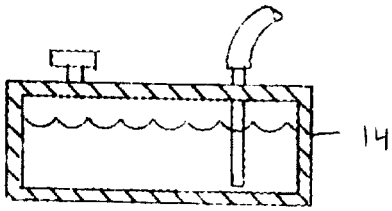
FIG. 6

TILE AND CARPET REMOVAL APPARATUS

CROSS-REFERENCE TO RELATED APPLICATIONS, IF ANY

This application claims the benefit, under 35 U.S.C. 119(e), of U.S. provisional application Serial No. 60/147,183, filed Aug. 5, 1999, pending.

STATEMENT REGARDING FEDERALLY SPONSORED RESEARCH OR DEVELOPMENT

Not applicable.

REFERENCE TO A MICROFICHE APPENDIX, IF ANY

Not Applicable.

BACKGROUND OF THE INVENTION

1. Field of the Invention.

The present invention relates, generally, to delaminating apparatus. More particularly, the invention relates to apparatus for removing old floor coverings. The invention is particularly useful for removing old floor coverings that contain asbestos or other hazardous materials.

2. Background Information.

The state of the art includes various devices and methods for removing old floor covering. Most of them have a sharp blade driven forward by a motorized wheel. Most of the blades have some angular control, and provisions are made to heavily load the blade with the weight of the vehicle by picking up the front wheel and/or pressing the blade down. For example, U.S. Pat. No. 5,830,313 to Smith discloses a blade with its angle of attack set by adjustable rods, and the front wheel is raised or lowered to engage or disengage the blade with the ground. U.S. Pat. No. 5,772,284 to Lindsey et al. discloses a hydraulic cylinder that pivots a blade to adjust its pitch between substantially vertical and substantially horizontal. U.S. Pat. No. 5,702,161 to Finney et al. discloses a blade connected to two articulated arms, the first arm pivoting about an axis near the front wheel to raise and lower the second arm, which pivots about the end of the first arm. With the first arm angled downward, the front wheel is lifted off the ground to heavily load the blade against the ground.

The devices in all of those patents include a powered wheeled vehicle as part of the device. None of them are designed to be attached to an existing small front end loader type vehicle, such as a Bobcat, or other type loader or forklift to thereby take advantage of the multi-axis motion and load applying capability available from such a vehicle.

U.S. Pat. No. 5,829,534 to Easton et al. discloses a power-driven oscillating blade attached to the front of a loader and uses the loader controls to adjust the angle of attack of the blade, but such a device with its oscillation mechanism and separate power source is very complex.

When the surface material being removed contains hazardous material such as asbestos, dust abatement is required. Additionally, the wheeled vehicle used to remove the material should not run over the removed material. Doing so further fractures the material and allows the hazardous material to be tracked throughout the work site by the tires of the vehicle. The Finney patent discloses the use of a water tank and spray nozzles to abate dust when removing asbestos-containing materials. But none of the patents disclose a device or method for gathering the removed material and preventing it from being run over by the wheeled vehicle.

The present invention provides an improved tile and carpet removing device which overcomes the limitations and shortcomings of the prior art.

BRIEF SUMMARY OF THE INVENTION

The present invention provides an apparatus and method for removing floor covering, such as tile and carpet from floors, particularly from large areas of concrete floors typically found in commercial buildings. The apparatus includes a frame having attachment features for attaching the frame to the front end of a loader type vehicle. An arm connects to and extends forward from the frame, and has a tapered end portion with a terminal end to which a blade attaches. The blade extends generally forward from the tapered portion of the arm and has a sharp edge for separating floor covering from a floor. A deflector extends upward from on top of the tapered portion to deflect removed materials off of the top of the tapered portion. At least one sweep is connected to the frame and extends downward from the frame to the floor as the vehicle is driven forward pressing the blade against the floor. The sweep is made of a resilient material and is vertically slidable relative to the frame to accommodate variations in the floor and vertical motion of the apparatus while maintaining contact with the floor to collect removed floor covering material ahead of the loader as the loader is moved forward to remove floor covering. A reservoir may optionally be supported by the arm and contain water or other liquid which is sprayed on the floor covering as it is removed to abate dust, which may contain hazardous material such as asbestos.

The features, benefits and objects of this invention will become clear to those skilled in the art by reference to the following description, claims and drawings.

BRIEF DESCRIPTION OF THE DRAWINGS

FIG. 4 is a side view of a Bobcat type loader using the tile and carpet removal apparatus of the present invention.

FIG. 5 is a perspective view of a portion of the apparatus showing one embodiment of a deflector.

FIG. 6 is a cross-sectional view of the arm of the apparatus illustrating use of the arm as a reservoir.

DETAILED DESCRIPTION

Figure 1:
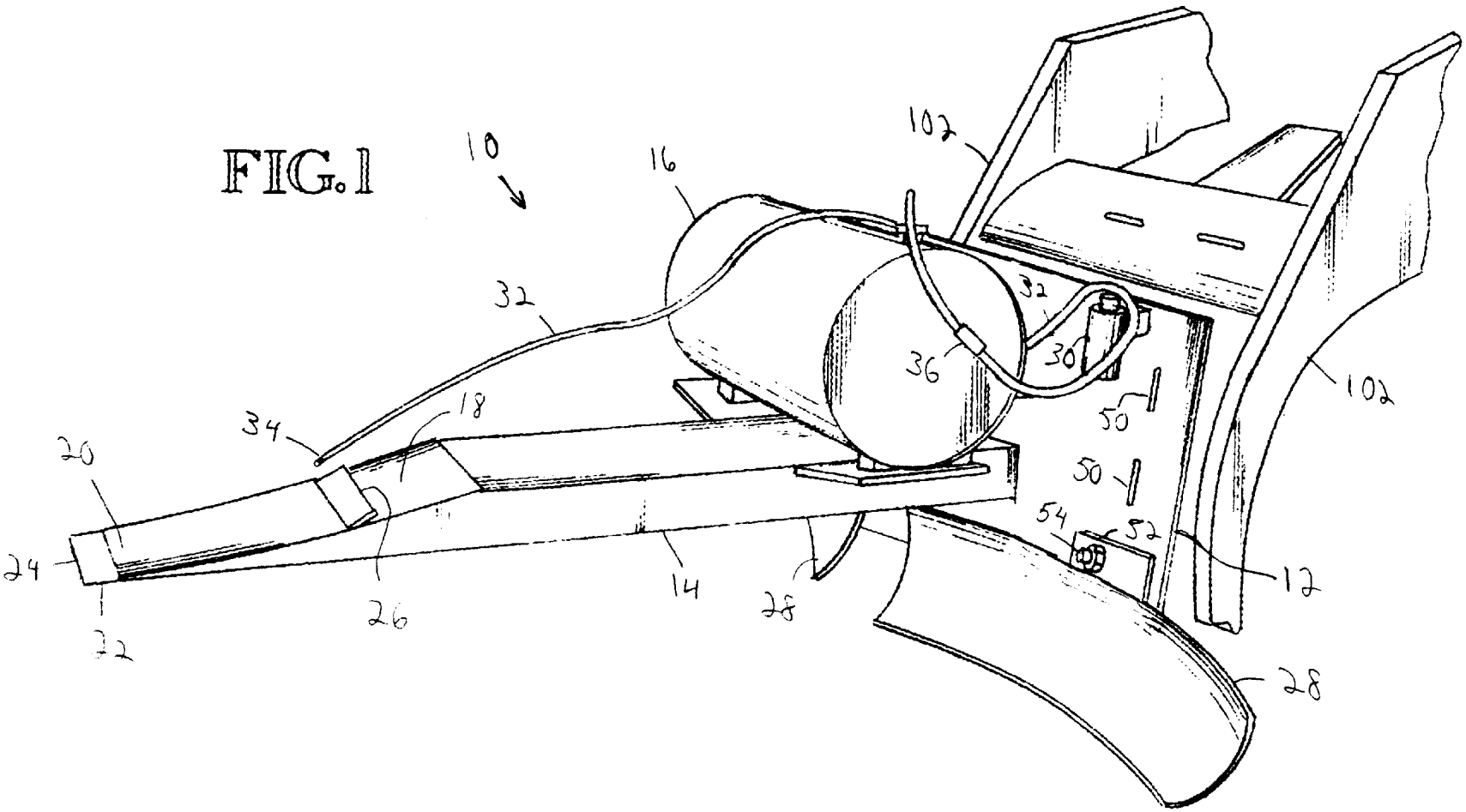
FIG. 1 is a perspective view of the tile and carpet removal apparatus of the present invention attached to the front end of a Bobcat type loader.

Referring to FIGS. 1 and 4, the tile and carpet removal apparatus 10 of the present invention is designed to be attached to a small front end loader 100, such as a Bobcat, or other vehicles, such as a or forklift, that provide vertical and tilting movement of an apparatus attached to the front of the vehicle. The apparatus 10 is used to remove tile, sheet goods such as linoleum, or carpet from concrete floors of buildings, particularly large commercial buildings. It is particularly useful where the tile or adhesive has asbestos which must be handled according to government regulations.

A frame structure 12 is provided which is oriented generally horizontally across the front of the loader 100 and attaches to the lifting members 102 of the loader. An arm 14 extends forward from the frame structure 12 and optionally supports a reservoir tank 16 which contains water used for dust control. Arm 14 may be made of any suitable structure of sufficient strength and stiffness to fully load the blade 22 at the end of arm 14 with the weight available from the operation of the loader vehicle. For example, it may be made of rectangular structural tubing as illustrated in FIG. 1, or it may be made of other structural elements such as square tubing, a single I-beam having a large cross-section, or a pair of smaller cross-section I-beams in horizontal spaced parallel arrangement connected by cross members. When large structural tubing is used, it may be feasible to close an interior portion of the tubing and use it as the reservoir, as shown in FIG. 6, instead of requiring an attached reservoir tank 16.

Figure 8:
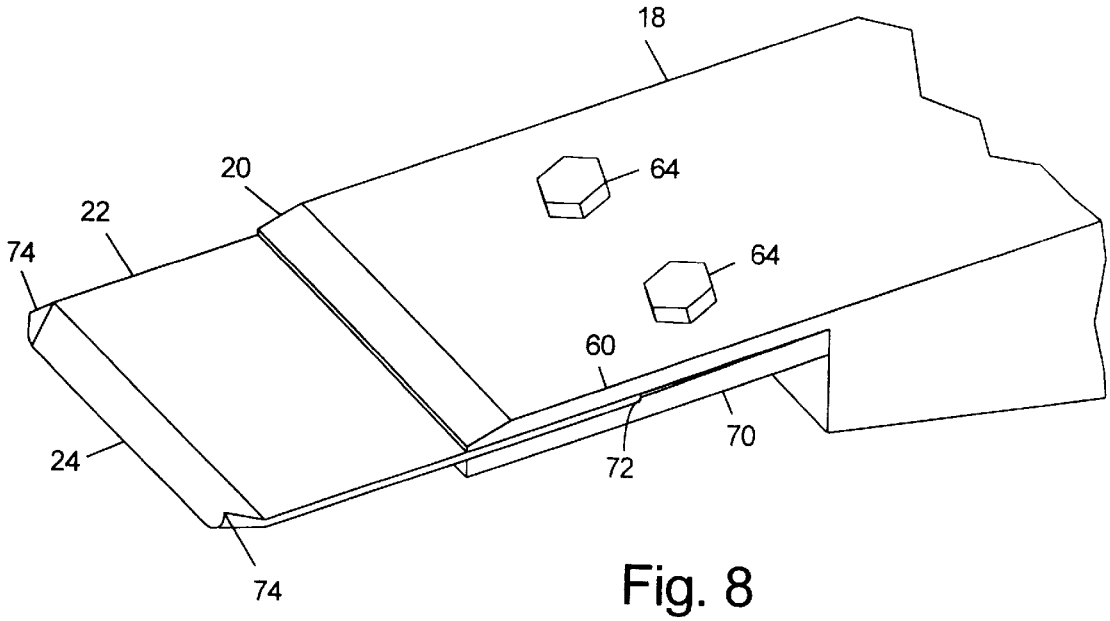
FIG. 8 is a perspective view of the end of the arm of the apparatus showing another embodiment for clamping the blade.

Referring again to FIG. 1, at the forward end of the arm 14 is a tapered portion 18 having a terminal end 20, which is preferably beveled, to which blade 22, preferably made of spring steel and having a sharp edge 24 attaches. Blades 22 can be various widths depending upon the need. For carpet removal, the sharp corners 74 of the blade optionally are bent or curved upward (as shown in FIG. 8) so that they cut the carpet into strips as the blade passes.

A deflector 26 is mounted on the top of the tapered portion 18 so that floor covering sliding up the tapered portion 18 will be deflected off to the side and not continue up onto the arm 14. Deflector 26 is preferably angled or curved upward more than tapered portion 18, but not so much as to stop material from sliding over it. The deflector 26 can have other configurations that function to deflect removed floor covering off the top of tapered portion 18. For example, as shown in FIG. 5, deflector 126 has a ridge 130 that rises from front to back and sides 132 and 134 that extend from ridge 130 to tapered portion 18 forming a wedge that will deflect material sliding up the top of tapered portion 18 to either side of it.

Referring to FIGS. 1–4, material deflected to the side of arm 14 is gathered by flexible sweeps 28 slidably attached to the bottom of the frame structure 12 to collect the removed material and keep it from being run over by the vehicle tires 104. If removed material is run over, additional dust, possibly contaminated with asbestos, may be released into the air and onto the vehicle tires 104 were it would be tracked throughout the job site. Also, driving the vehicle over removed materials makes it more difficult to control the blade 22 since the surface over which the vehicle moves is then irregular.

Figure 2:
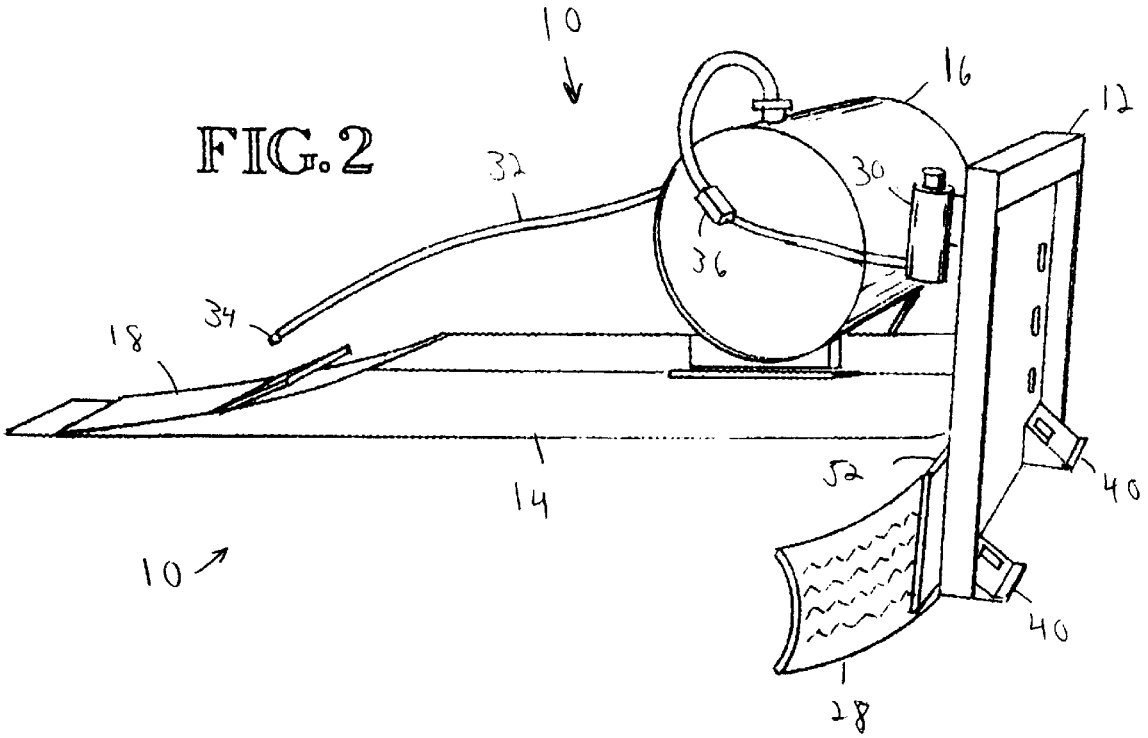
FIG. 2 is a perspective view of the tile and carpet removal apparatus of the present invention unattached to a vehicle and showing the back of the apparatus.

The sweeps 28 are resilient and flexible and have the ability to accommodate some vertical motion of frame 12 relative to the floor so that they stay in contact with the floor as frame 12 is pivoted or moved vertically within a range. Portions of old tires can be used as sweeps 28. They are tough, resilient and have a natural forward-facing curvature when mounted as illustrated in FIGS. 1 and 2, which aids in gathering material. Vertical motion of sweeps 28 is, preferably, accomplished by a slidable connection between frame 12 and sweep 28. Frame 12 preferably has at least one vertically oriented, forward facing slot 50 at both sides. Sweeps 28 are fixedly attached to plates 52, such as by bolting, and plates 52 are disposed in front of slots 50. Plates 52 can slide vertically relative to frame 12 by means of a fastener 54 which is received by slot 50 and is attached to plate 52. Fastener 54 may be any suitable device, such as a bolt, pin or bar which allows a slidable attachment between plate 52 and frame 12 through slot 50 and will retain plate 52 against frame 12. The resiliency of sweep 28 also provides vertical flexibility of its bottom edge to accommodate small variations in the surface from which material is being removed.

Referring to FIGS. 1 and 2 , reservoir tank 16 provides water to a pump 30 which pumps it through a tube 32 to a nozzle 34 located above the tapered portion 18. The pump 30 is preferably electrically operated and controlled by the loader operator. A valve 36, such as an electrically actuated solenoid valve, is used to shut off the source of water to the pump 30 to prevent water in tank 16 from being siphoned out when pump 30 is not actuated. Water is sprayed onto floor tile as it is being removed by the blade to abate dust generated by the tile removal process.

Figure 3:
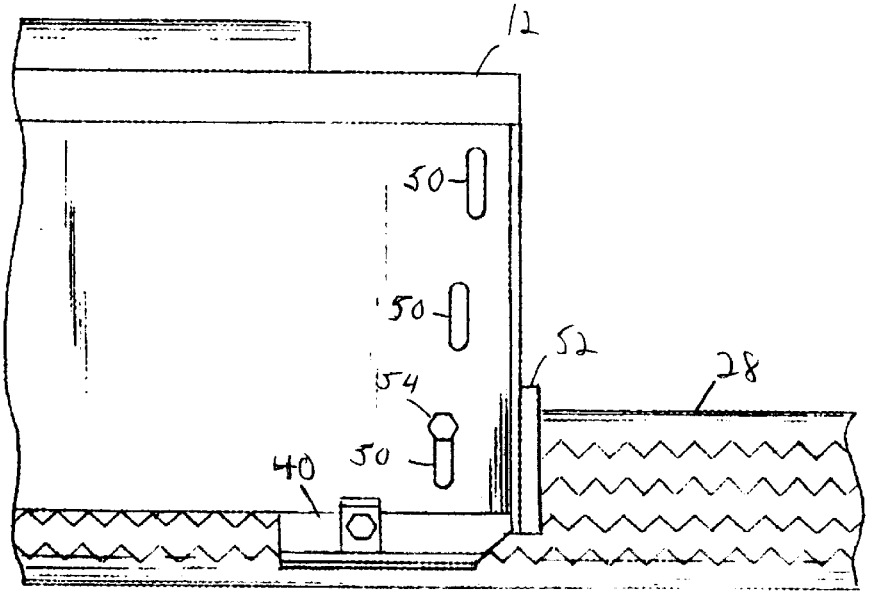
FIG. 3 is a perspective view of a portion of the back of the apparatus of FIG. 2 showing the attachment features of the apparatus and the attachment of the flexible sweep.

Referring to FIGS. 2 and 3, frame 12 has attachment features 40 for attaching apparatus 10 to loader 100 or other appropriate vehicle. The attachment features 40 are the same configuration as on a bucket or other implement designed for attaching to the vehicle.

Figure 7:
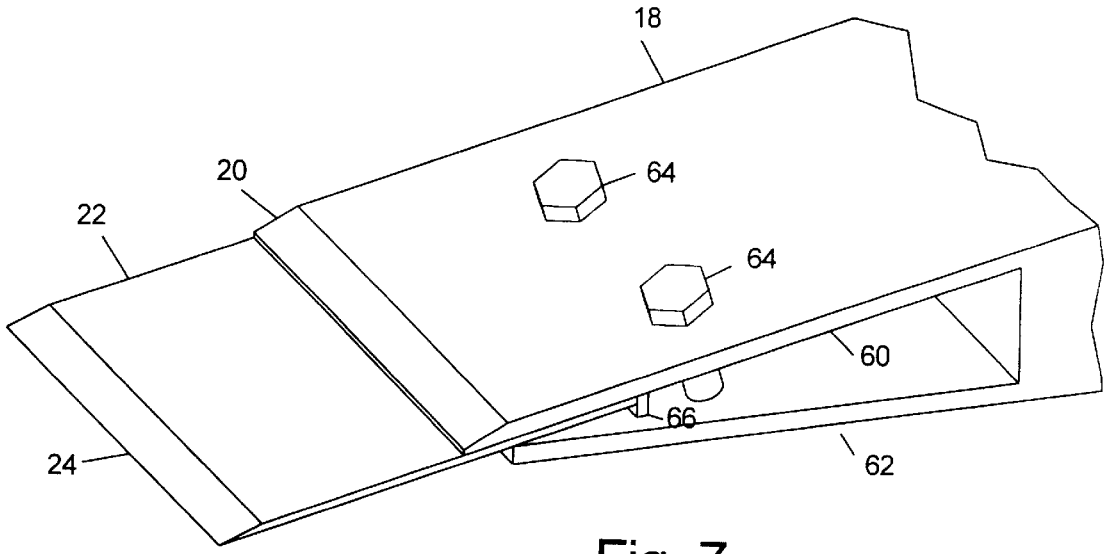
FIG. 7 is a perspective view of the end of the arm of the apparatus showing one embodiment for clamping the blade.

Referring to FIGS. 7 and 8, blade 22 can be attached to tapered portion 18 at end 20 by any suitable means. It is desirable to minimize protrusions above tapered portion 18 in front of deflector 26 so as not to cause material to accumulate on top of tapered portion 18.

In the embodiment shown in FIG. 7, for example, tapered portion 18 has an upper member 60 and a lower member 62 that converge at end 20. Upper member 60 and lower member 62 can be clamped together, such as by at least one bolt 64, to clamp blade 22 securely between upper member 60 and lower member 62 at end 20. Two bolts are preferred. Bolts 64 may have nuts to provide clamping force, or bolts 64 may threadably engage lower member 62 to provide the clamping force. Alternatively, bolts may be inserted from the bottom through lower member 62 and have nuts above upper member 60 or threadably engage upper member 60. A stop 66 can be attached to upper member 60 between upper member 60 and lower member 62 to locate blade 22 when it is installed and also to prevent blade 22 from being pushed backward as it removes floor covering.

In the embodiment shown in FIG. 8, tapered portion 18 has an upper member 60 against which a separate lower plate 70 is clamped, such as by at least one bolt 64. Two bolts are preferred. Plate 70 preferably has a recess 72 which receives blade 22 and is constructed and arranged such that blades 22 will be tightly clamped between upper member 60 and lower plate 70 when bolts 64 are tightened. Recess 72 provides a similar function as stop 66 in FIG. 7. Bolts 64 may threadably engage plate 70 or nuts may be used with bolts 64 to provide clamping force.

Referring also to FIG. 4, in operation, arm 14 is positioned such that sharp edge 24 of blade 22 is pressed heavily down against the floor and pushed forward by an operator driving the loader 100. The loader can apply great pressure to the blade so that the blade easily slides under tile, linoleum or carpet to be removed. As the blade is pushed forward, loosened material slides up the beveled end 20 and up the tapered portion 18 until it is deflected off to the sides by deflector 26. The loosened material then falls to the ground and is gathered in front of the loader by sweeps 28 as the loader moves forward. For large sheet goods, or multiple layers of tile, when the tapered portion 18 is pushed a long way under the material, the loader can lift the arm 14 and often fracture and remove a large chunk of material. The ability of the arm 14, tapered portion 18 and blade 20 to move vertically is a significant advantage in that is helps loosen, breakup and remove large sections of material. The tilting capability of a loader further enhances the maneuverability of the arm 14 to remove material.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. An apparatus for removing covering from a floor, comprising:

(a) a frame having attachment features for attaching the frame to the front end of a loader vehicle;

(b) an arm connected to the frame and extending forward from the frame, the arm having a tapered portion with a terminal end;

(c) a blade attached to the terminal end of the tapered portion of the arm, the blade extending generally forward from the tapered portion of the arm; and (d) at least one non-bristled sweep connected to the frame and extending downward from the frame to the floor, the sweep being made of a resilient material.

2. The apparatus of claim 1, wherein the blade has a forward edge that is sharp.

3. The apparatus of claim 2,wherein the forward edge of the blade has corners bent upward.

4. The apparatus of claim 1, wherein the blade is made of spring steel.

5. The apparatus of claim 1, wherein the blade is attached to the terminal end of the tapered portion by a clamping device.

6. The apparatus of claim 5, wherein the clamping device includes a member connected to the tapered portion, a plate disposed below the member and at least one fastener engaging the plate and the member, the blade being disposed between the member and the plate, the at least one fastener providing clamping force between the plate and the member to clamp the blade therebetween.

7. The apparatus of claim 5, wherein the clamping device includes a first member connected to the tapered portion and a second member connected to the tapered portion, the first and second members converging at the terminal end, the blade being disposed between the first and second members and clamped therebetween.

8. The apparatus of claim 7, wherein the clamping device further includes at least one clamping feature to provide clamping force between the first and second members.

9. The apparatus of claim 8, wherein the clamping feature is at least one threaded fastener.

10. The apparatus of claim 1, further comprising a deflector attached to the tapered portion of the arm, the deflector extending upward from the tapered portion to deflect material removed from the floor off of the arm.

11. The apparatus of claim 10, wherein the deflector is curved upward.

12. The apparatus of claim 10, wherein the deflector has a ridge rising upward and rearward from the tapered portion and sides extending downward and outward from the ridge to the tapered portion.

13. The apparatus of claim 1, wherein the arm has a hollow portion containing liquid used to abate dust during removal of floor covering.

14. An apparatus for removing covering from a floor, comprising:

(a) a frame having attachment features for attaching the frame to the front end of a loader vehicle;

(b) an arm connected to the frame and extending forward from the frame, the arm having a tapered portion with a terminal end;

(c) a blade attached to the terminal end of the tapered portion of the arm, the blade extending generally forward from the tapered portion of the arm; and (d) at least one non-rotating sweep connected to the frame and extending downward from the frame to the floor, the sweep being made of a resilient material, the at least one non-rotating sweep slidably engaging the frame so that the sweep can move vertically relative to the frame to keep the sweep in contact with the floor as the frame is raised or lowered within a limited range.

15. An apparatus for removing covering from a floor, comprising:

(a) a frame having attachment features for attaching the frame to the front end of a loader vehicle;

(b) an arm connected to the frame and extending forward from the frame, the arm having a tapered portion with a terminal end;

(c) a blade attached to the terminal end of the tapered portion of the arm, the blade extending generally forward from the tapered portion of the arm; and (d) at least one non-rotating sweep connected to the frame and extending downward from the frame to the floor, the sweep being made of a resilient material, (e) a liquid storage container connected to and supported by the arm, a nozzle disposed above the tapered portion of the arm, tubing connecting the nozzle to the liquid storage container and providing for transfer of liquid from the storage container to the nozzle, and a pump for moving the liquid from the storage container through the tubing and the nozzle.

16. The apparatus of claim 15, wherein the pump is electrically actuated by an operator of the vehicle.

17. The apparatus of claim 15, further comprising a valve in fluid communication with the tubing, the valve being selectively positionable to either permit or prevent flow through the tubing.

18. The apparatus of claim 17, wherein the valve is an electrically actuated solenoid valve.

19. A method of removing floor covering from a floor comprising steps of:

(a) attaching to a loader vehicle an apparatus for holding a sharp blade in contact with the floor;

(b) moving the loader on the floor to push the blade under the floor covering to remove a portion of the floor covering from the floor;

(c) deflecting the removed floor covering off the apparatus; and (d) pushing the removed floor covering in front of the loader as the loader vehicle moves forward with at least one non-bristled resilient sweep connected to the apparatus and extending downward to the floor.

20. The method of claim 19, further comprising the step of applying liquid to a portion of floor covering as it is removed to abate dust caused by removal of the floor covering.

21. An apparatus for removing covering from a floor, comprising:

(a) a frame having attachment features for attaching the frame to the front end of a loader vehicle;

(b) an arm connected to the frame and extending forward from the frame, the arm having a terminal end;

(c) a blade attached to the terminal end of the arm and extending generally forward from the terminal end; and (d) at least one sweep connected to the frame and extending downward from the frame to the floor, the sweep being made of a resilient material and being curved forward to aid in gathering material removed from the floor.

* * * * *